US005427248A

United States Patent [19]

Levy et al.

[11] Patent Number: 5,427,248

[45] Date of Patent: Jun. 27, 1995

[54] APPARATUS FOR THE SEPARATION OF TOBACCO LAMINA FROM TOBACCO STEM

[75] Inventors: Sam Levy; James H. Lowe, Jr., both of Richmond, Va.

[73] Assignee: MacTavish Machine Manufacturing Co., Richmond, Va.

[21] Appl. No.: 326,595

[22] Filed: Oct. 20, 1994

[51] Int. Cl.[6] ..... B07B 4/00

[52] U.S. Cl. ..... 209/137; 209/139.1; 209/154

[58] Field of Search ..... 209/134–139.1, 209/143, 154, 147, 149

[56] References Cited

U.S. PATENT DOCUMENTS

| | | | |
|---|---|---|---|
| 2,130,880 | 9/1938 | Durning | 209/139.1 X |
| 2,163,833 | 6/1939 | Eissmann | 209/139.1 X |
| 2,173,087 | 9/1939 | Eissmann | 209/139.1 X |
| 2,643,768 | 6/1953 | Eissmann | 209/139.1 X |
| 2,815,860 | 12/1957 | Krantz et al. | 209/139.1 X |
| 3,173,861 | 3/1965 | Hager et al. | 209/137 |
| 3,262,457 | 7/1966 | Gamberini | 209/137 X |
| 3,308,950 | 3/1967 | Harte et al. | 209/137 |
| 3,378,140 | 4/1968 | Wochnowski et al. | 209/137 |
| 3,542,037 | 11/1970 | Pietralunga | 209/137 X |
| 3,593,851 | 7/1971 | Davidson | 209/139.1 X |
| 3,608,716 | 9/1971 | Rowell et al. | 209/139.1 |
| 4,465,194 | 8/1984 | Coleman . | |
| 4,701,256 | 10/1987 | Cross, Jr. | 209/139.1 |
| 4,915,824 | 4/1990 | Surtees | 209/137 X |
| 5,205,415 | 4/1993 | Surtees | 209/139.1 X |

*Primary Examiner*—D. Glen Dayoan
*Attorney, Agent, or Firm*—Norman B. Rainer

[57] ABSTRACT

A modular pneumatic type tobacco separator apparatus employs a separation chamber which receives a threshed tobacco mixture at a feed trough at an upper elevation, and receives an upwardly directed air stream at a lower elevation. The air stream separates the mixture into lamina material, which is blown upwardly and removed by way of a screening separator, and stem material which falls to the bottom of the chamber, and is removed by an upwardly inclined conveyor belt. The configuration of the apparatus is such that, when two units of the apparatus are placed interactively together, the stem material emergent from a first unit drops by gravity into the feed trough of the next successive downstream unit of the apparatus.

12 Claims, 3 Drawing Sheets

APPARATUS FOR THE SEPARATION OF TOBACCO LAMINA FROM TOBACCO STEM

BACKGROUND OF THE INVENTION

1. Field of the Invention

This invention relates to the handling of tobacco materials, and more particularly concerns apparatus for separating pieces of tobacco lamina material from heavier tobacco stem material.

2. Description of the Prior Art

In the production of cigarettes, dried and cured whole tobacco leaves are subjected to a threshing operation which fragments the leaf into a mixture of leafy or lamina pieces, and heavier pieces referred to as stem or midrib material. The lamina pieces, which are of thin, filmy configuration, represent the valuable component for use in the production of cigarettes. The stem material, generally of elongated and relatively thick configuration is relatively undesirable for use in cigarette production. It is therefore sought to separate the lamina material from the stem material.

In general, devices employing air currents to separate tobacco lamina from stem material are well know. Examples of such devices include those disclosed in U.S. Pat. No. 4,454,194 to Coleman, U.S. Pat. No. 3,608,716 to Rowell, and U.S. Pat. No. 3,265,210 to Haite et al. In such separator devices, a threshed mixture is entered into a chamber where it is acted upon by an upward flow of air. The aerodynamically lighter lamina pieces are carried upwardly by the air current whereas the heavier stem material falls to a lowermost region of the chamber.

In practice, the upwardly delivered pieces of lamina are removed from the chamber and forwarded toward the next step in the manufacture of cigarettes or other tobacco products. The heavy stem material, however, is forwarded to the entrance port of a next successive downstream separator or thresher, the reason being to glean any residual fragments of valuable lamina material from the stem material. It is not uncommon for the stem material to pass sequentially through a series of four or five separators in a linear arrangement. Several such lines of separators are customarily utilized in typical factory installations.

The considerable floor space occupied by the arrays of separators translates to increased manufacturing expense. The separators further produce a significant problem of air-borne dust in the factory environment. Noise level is a further problem. The energy requirements of the separators is a significant factor, especially the amount of energy required in transporting the heavy stem material. The installation of an array of separators usually involves significant expense for ancillary or support features such as means for supplying the necessary air flow, and means for delivering stems exiting one separator to the entrance of the next separator.

A particularly challenging problem in the operation of pneumatic tobacco separators is to secure efficient utilization of the working air stream. In order to achieve the desired separation of components, the tobacco mixture must be contacted within a confining chamber by an upwardly directed laminar flow of air of substantially uniform velocity throughout the chamber. The chambers are generally of large volume and laterally elongated. Air supply conduits, however, are generally of circular contour, having a cross-section area much smaller than that of the chamber. Difficulties are consequently encountered in causing the air flow from a small conduit to spread out to provide a laminar flow pattern of uniform velocity throughout the chamber.

It is accordingly an object of the present invention to provide apparatus for pneumatically separating a threshed tobacco mixture into stem and lamina fractions.

It is further object of this invention to provide separator apparatus as in the foregoing object which occupies relatively little floor space and readily interacts with other similar separators in a linear array.

It is another object of the present invention to provide a separator of the aforesaid nature which minimizes production of air-borne dust in the adjacent environment.

It is a still further object of this invention to provide a separator of the aforesaid nature which requires reduced energy consumption and permits lower installation cost.

It is yet another object of the present invention to provide a separator of the aforesaid nature which provides improved efficiency of utilization of an activating air stream.

These and other beneficial objects and advantages will be apparent from the following description.

SUMMARY OF THE INVENTION

The above and other beneficial objects and advantages are accomplished in accordance with the present invention by a tobacco separator apparatus comprising:

a) a separation chamber defined by opposed side panels, opposed front and rear panels, and upper and lower closure structure, b) a feed trough associated with said front panel for entering a tobacco mixture into said chamber, c) a screening separator communicating with said chamber adjacent said upper closure structure, and disposed rearwardly of said rear panel, said screening separator being elongated between opposed lateral extremities and adapted to separate lamina from a carrier air stream, causing said lamina to fall downwardly by gravity effect, d) conveying means disposed below said screening separator to receive said lamina and transport it in a direction generally orthogonal to said side panels, e) a return conduit coupled to each lateral extremity of said screening separator and descending to a lowermost extremity, f) at least one centrifugal blower having an inlet port coupled to the lowermost extremity of a corresponding return conduit, and an exit port, g) a feed conduit coupled to the exit port of each blower and terminating in an upwardly directed exit extremity communicating with said chamber at said lower closure structure, thereby establishing a circuitous, substantially closed path of movement of the stream of air generated by said blowers, h) means associated with said feed conduit for controlling the air velocity and distribution, and i) an upwardly inclined conveyor belt having a lower extremity that receives stem material from said chamber, and an upper extremity located behind said rear panel at an elevation above said feed trough.

In preferred embodiments of the apparatus of this invention, a winnower wheel may be positioned within the chamber adjacent the rear panel. The wheel functions to propel air-suspended particles transversely to the air stream, thereby subjecting the particles to additional separational action by the air stream. An air bleed portal is preferably provided adjacent the blower where joinder is made with the feed conduit. The purpose of bleeding air from the blower is to cause the interior of the chamber to be at a negative pressure with respect to the surrounding ambient air. Therefore, no dust-laden air will leak from the chamber into the adjacent environment.

The feed conduit preferably has a long path length, consistent with the other characteristics of the apparatus. The purpose of the long path length is to better enable the air stream emergent from the blowers to spread laterally across the width of the chamber. Achievement of said longer length may require at least two significant directional bends in the feed conduit. The apparatus of this invention is critically designed so as to function in a modular manner wherein interaction with other similar units of this apparatus is easily achieved with minimal installation effort. The compactness of the present apparatus also requires minimal floor space.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
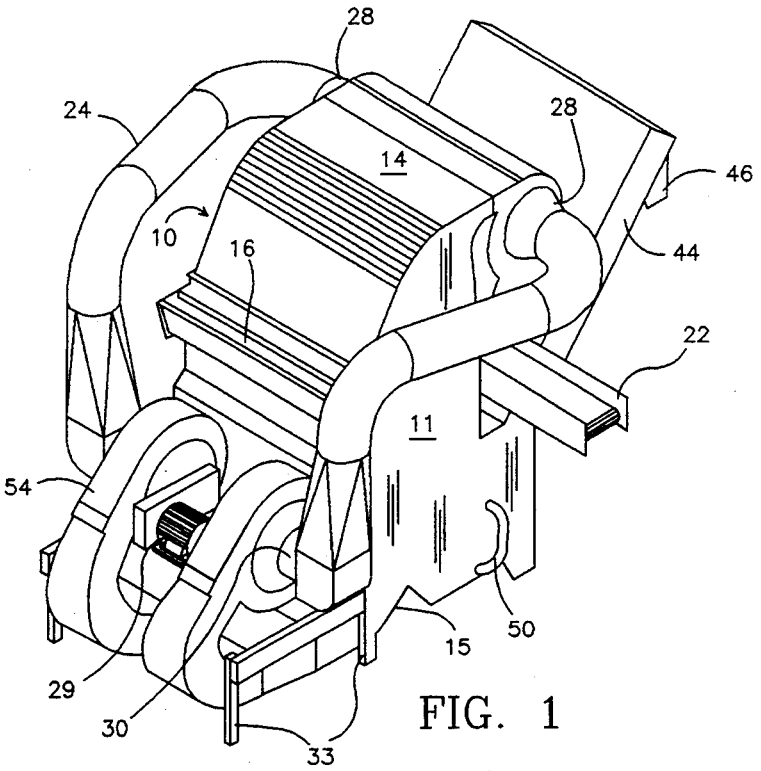
FIG. 1 is a front perspective view of an embodiment of the separator apparatus of the present invention.

Referring to FIGS. 1–5, an embodiment of the separator apparatus of this invention is shown having a generally upright separation chamber 10 defined in part by opposed side panels 11, opposed front and rear panels 12 and 13, respectively, and upper and lower closure structure 14 and 15, respectively. Said panels and closure structure may be fabricated of sheet metal which is fitted together to provide a chamber which is air tight except for functional openings. Transparent panels may be employed in part to permit visual observation of the interior of the chamber. Chamber 10 and other components of the apparatus are supported by exterior framework 33. The distance between side panels 11 is considered to be the width of the chamber. Said width will be about 5 feed for "narrow" separator machines, and will range from five feet to 12 feet for "wide" separator machines.

A horizontally elongated feed trough 16 is attached to front panel 12 at an elevation adjacent upper closure structure 14. A rotary paddle wheel 17 is disposed within 16 trough for the dual purpose of advancing threshed tobacco mixture into chamber 10, and preventing outflow of air therefrom.

A screening separator 18 elongated between lateral extremities 28 is disposed rearwardly of rear panel 13 and adjacent upper closure structure 14. Screening separator 18 operates on a centrifugal blower principle wherein air and suspended tobacco particles emergent from upper closure structure 14 of chamber 10 enter entrance port 19 of said screening separator. A screen device within separator 18 removes air-suspended lamina tobacco particles, which fall downwardly by gravity into a rotary air lock device 20 and thence downwardly past discharge extremity 21. The lamina emergent from separator 18 are received by substantially horizontally disposed conveyor belt 22 which transports the lamina away from the apparatus in a direction transverse to side panels 11 of chamber 10. Screening separator 18 is preferably provided with a dual lip flexible seal which provides assurance against malfunction by way of a torn or worn sealing lip.

Return conduits 24 are attached at their upper extremities 25 to the air exit port 26 at both lateral extremities of screening separator 18. Each conduit 24 terminates in a downstream lowermost extremity 27.

Paired centrifugal blowers 54 are disposed forwardly of chamber 10 and positioned between the vertical planes of side panels 11. Said blowers are driven by the single motor 29. Each blower has an axially directed inlet port 30 coupled to the lower extremity 27 of a corresponding return conduit, and a tangentially directed exit port 31. The paired blowers are particularly beneficial on wide separator machines. On narrow separator machines, a centrally positioned single blower may be employed.

A feed conduit 32 is coupled to the exit port 31 of each blower. The conduit is initially forwardly and downwardly directed, then proceeds through a major bend 57 bent at an angle A of over 90 degrees of angle with respect to horizontal, and thence proceeds through a horizontal portion 35 to a second, lesser bend 34 bent at an angle B of between about 40 and 90 degrees of angle.

Within horizontal portion 35, conduit 32 is configured to have a progressively increased cross-sectional area. Said feed conduit terminates in an upwardly directed exit extremity 36 positioned within chamber 10 adjacent lower closure structure 15. The aforesaid arrangement of components establishes a circulating, substantially closed path of movement of a stream of air within the apparatus.

A series of adjustable vanes 37 is positioned within horizontal portion 35 of conduit 32. A first series of fixed vanes 38 is positioned within conduit 32 at lesser bend 34. A diffuser plate 39 and a second series of fixed vanes 40 are disposed within conduit 32 just prior to exit extremity 36. A self-cleaning slide plate 55 is disposed upon exit extremity 36 to control the flow of air emergent from conduit 32 and to aid the downward and rearward movement of heavy stem material. As shown in greater detail in FIGS. 4 and 5, slide plate 55 is comprised of a grate of parallel longitudinal members such as bars 58.

An upwardly inclined conveyer belt 41 has a lower portion 42 disposed within chamber 10 adjacent lower closure structure 15 and rearwardly displaced from exit extremity 36 of conduit 32. Said lower portion 42 is positioned to receive stem material transported by slide plate 55. The upper extremity 43 of belt 41 is located behind chamber 10 at an elevation above feed trough 16. Conveyer belt 41, which may have a series of cleats 60, functions to convey stem material upwardly out of chamber 10. Said conveyor belt is enclosed within rectangular housing 44 whose bottom surface 45 is provided with an exit spout 46 positioned below upper extremity 43 of belt 41, and through which the stem material falls.

Figure 3:
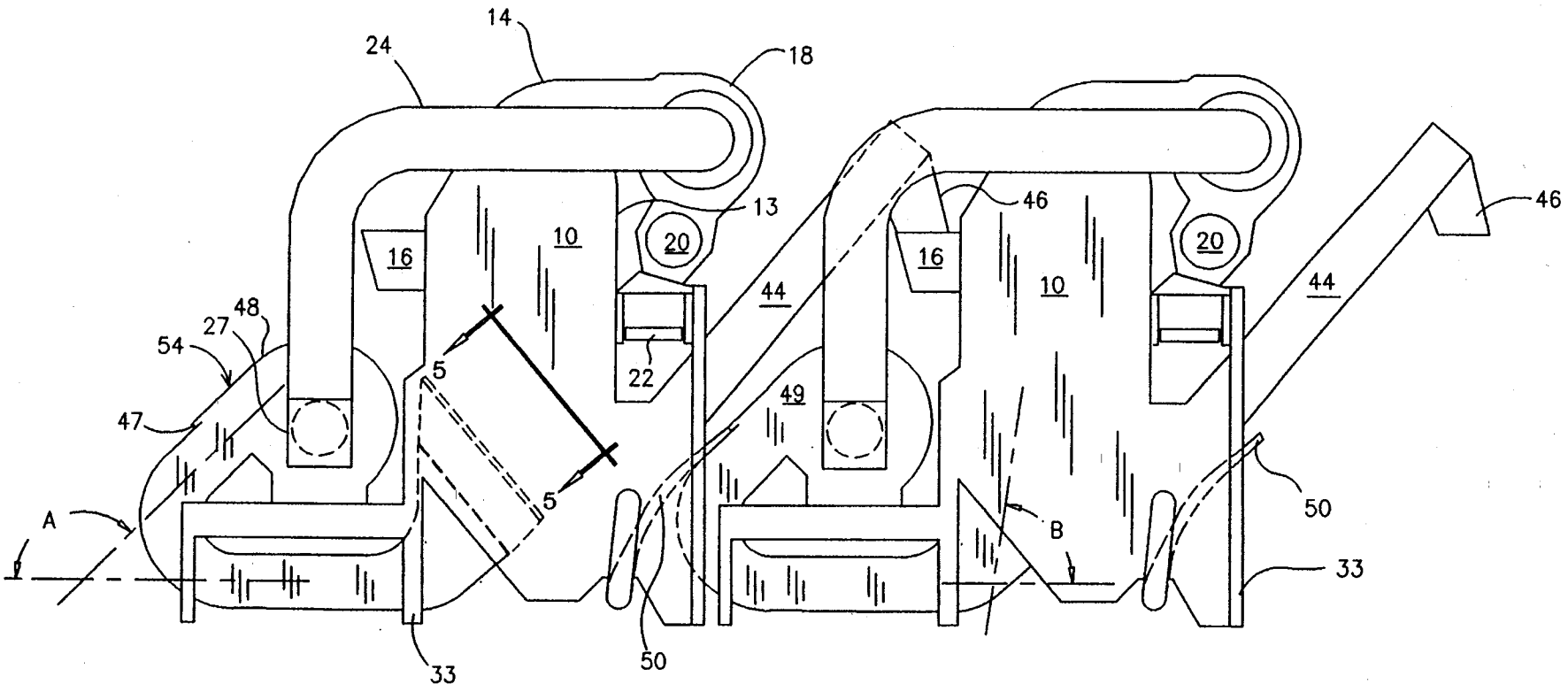
FIG. 3 is a side view showing two units of the apparatus of FIG. 1 in operative interaction.
Figure 4:
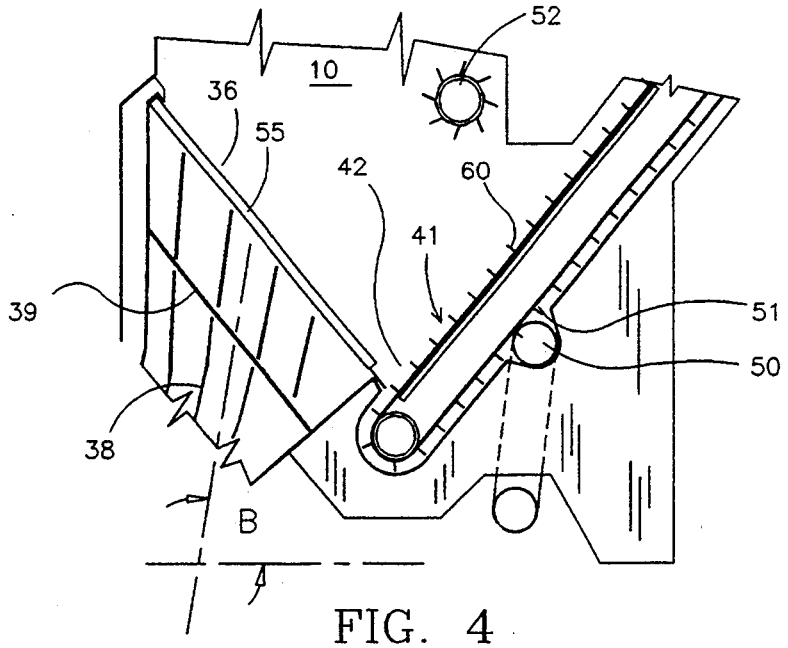
FIG. 4 is an enlarged fragmentary sectional side view.
Figure 5:
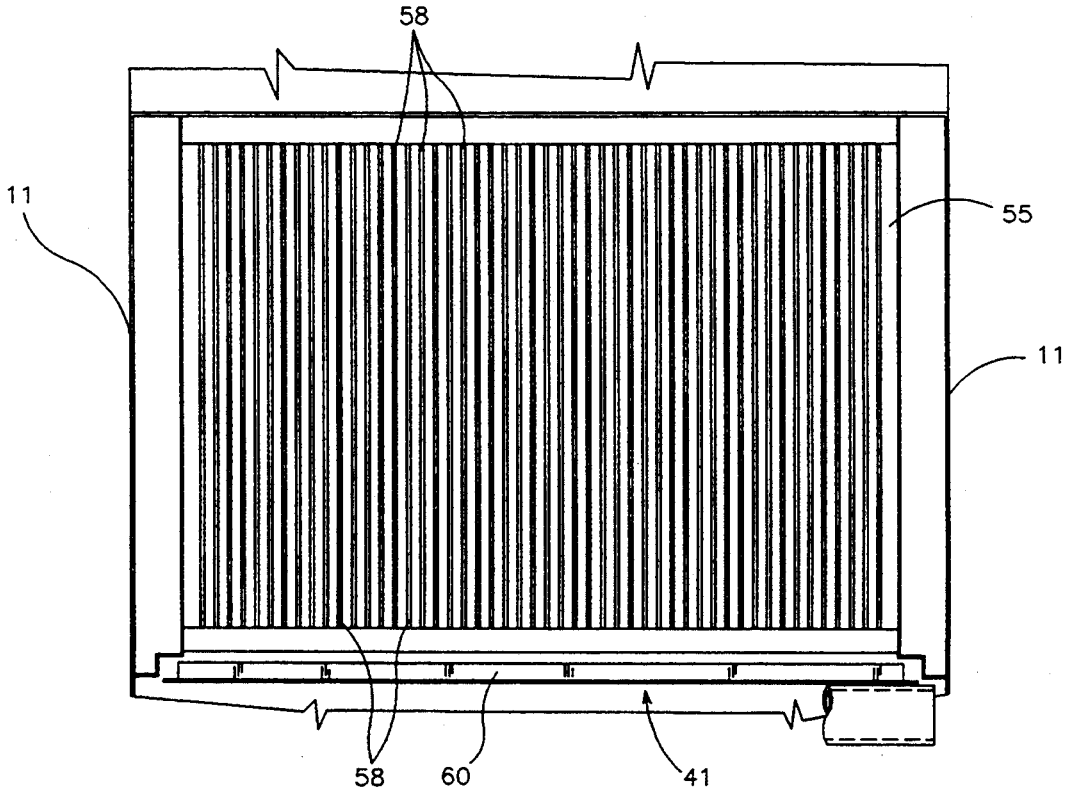
FIG. 5 is an enlarged fragmentary plan view taken in the direction of the arrows upon the line 5—5 of FIG. 3.

As shown in FIG. 3, the configuration and dimensions of the apparatus of this invention are such that stem material falling through spout 46 is caused to enter the feed trough 16 of the next adjacent similar separator apparatus. The apparatus of this invention can accordingly be said to be of modular design because a number of units of the apparatus can easily be operatively assembled without need of auxiliary equipment.

An air bleed outlet 47 is positioned in exit port 31 of each blower adjacent the outer perimeter 48 of blower housing 49. The positioning of outlet 47 is such as to facilitate removal of fine air borne particles which are flung in centrifugal action toward the outer perimeter of the blower housing. The venting of air through outlet 47 also causes the pressure within chamber 10 to be desirably below the pressure of the ambient surrounding air. A connecting conduit 50 receives the airstream emergent from outlet 47, and delivers it forwardly to the underside 51 of conveyor belt 41 of the next preceding unit of the apparatus of this invention. Said bleed air stream is caused to sweep transversely across said underside 51, and thereby serves to dislodge any tobacco particles still clinging to the belt. Any particles thereby dislodged are transported to a dust collection facility.

Figure 2:
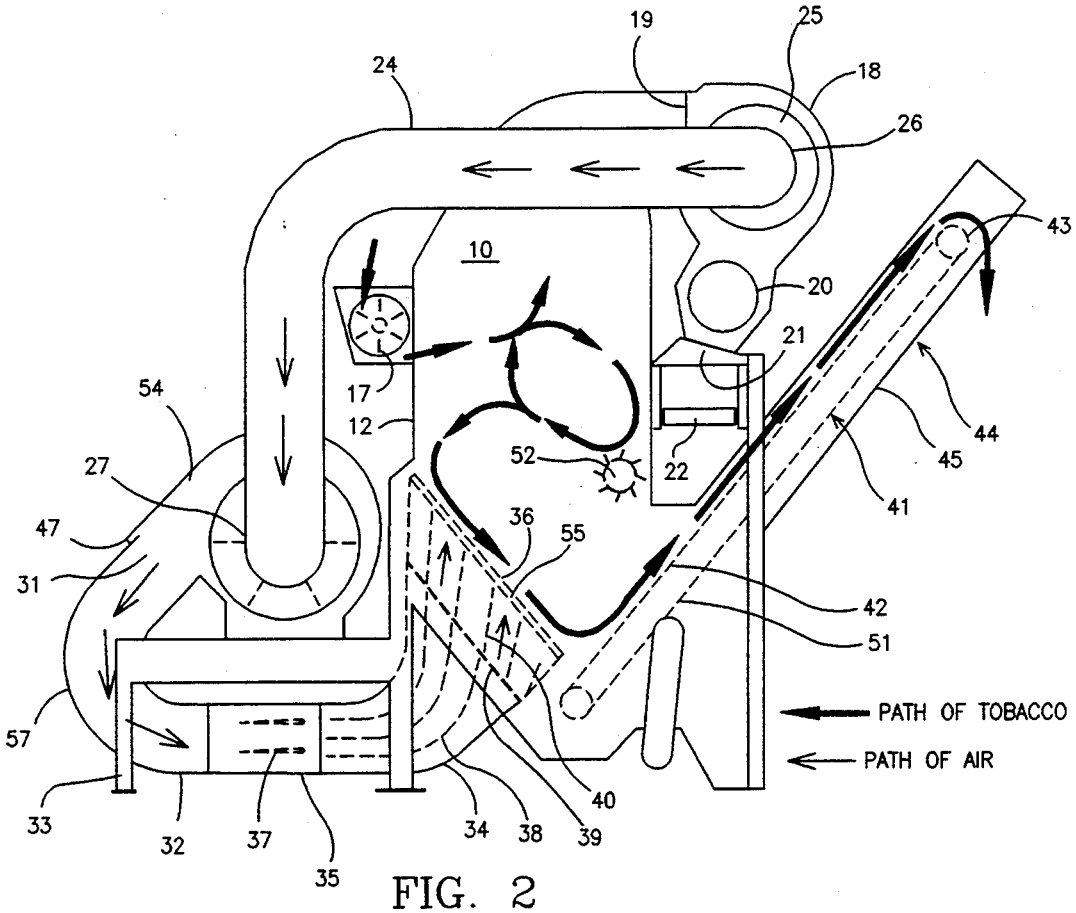
FIG. 2 is a schematic side view.

In FIG. 2, the general paths of the light and heavy pieces of tobacco, and the air paths are generally indicated by directional arrows. A winnower roll 52 having the shape of an elongated paddlewheel is mounted adjacent the rear panel of chamber 10, and serves to propel pieces of tobacco into repeat contact with the upwardly moving airstream.

The combination of the dual blowers associated with the relatively long and widened feed conduits 32 having double bends promotes uniform lateral distribution of the air stream. This is particularly useful for wide separator machines. The combined effects of adjustable vanes 37, fixed vanes 38 and 40, and diffuser plate 39 is to produce a laminar upward flow of air into chamber 10, said flow being of substantially uniform velocity throughout the chamber. Such flow characteristics produce highly efficient separation of tobacco pieces. The fact that the apparatus contains its own blowers and blower motor means that multiple units of the apparatus can be assembled without concern for the construction of separate conduits to supply air from a remote blower. By minimizing the total length of pneumatic conduits, such as conduit lengths that usually extend between tobacco separators of prior art construction, there is a savings in energy requirements and reduced noise level. It is to be further noted that the blowers and downwardly directed portions of the feed conduits are sloped to match the upward slope of housing 44. This permits close-fitting abutment of adjacent units of the apparatus of this invention, thereby minimizing floor space requirements.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. Apparatus for utilizing an air stream to separate tobacco lamina and stem material, said apparatus comprising:

a) a separation chamber defined by opposed side panels, opposed front and rear panels, and upper and lower closure structure, b) a feed trough associated with said front panel for entering a tobacco mixture into said chamber, c) a screening separator communicating with said chamber adjacent said upper closure structure, said screening separator being elongated between opposed lateral extremities and adapted to separate lamina from a carrier air stream, causing said lamina to fall downwardly by gravity effect, d) conveying means disposed below said screening separator to receive said lamina and transport it in a direction generally orthogonal to said side panels, e) a return conduit coupled to each lateral extremity of said screening separator and descending to a lowermost extremity, f) at least one centrifugal blower having an inlet port coupled to the lowermost extremity of a corresponding return conduit, and an exit port, g) a feed conduit coupled to the exit port of each blower and terminating in an upwardly directed exit extremity communicating with said chamber at said lower closure structure, thereby establishing a circuitous, substantially closed path of movement of the stream of air generated by said blowers, h) means associated with said feed conduit for controlling the air velocity and distribution, and i) an upwardly inclined conveyor belt having a lower extremity that receives stem material from said chamber, and an upper extremity located behind said rear panel at an elevation above said feed trough.

2. A series of at least two of the separator apparatus of claim 1 disposed in a manner wherein said upper extremity of the upwardly inclined conveyor belt of a first apparatus is positioned directly above the feed-trough of a second, next successive apparatus.

3. The separator apparatus of claim 1 of narrow design equipped with a single centrifugal blower.

4. The separator apparatus of claim 1 of wide design equipped with two centrifugal blowers.

5. The apparatus of claim 4 wherein said two blowers are driven by a single motor.

6. The series of apparatus of claim 2 wherein said conveyor belts are characterized in having an upper, advancing surface, and a lower, return surface.

7. The series of apparatus of claim 6 wherein a bleed stream of air is routed from a blower of said second apparatus to said first apparatus where said stream of air is directed transversely across the return surface of said conveyor belt.

8. The apparatus of claim 1 wherein the cross-sectional area of said feed conduit increases in going from said blower to said exit extremity.

9. The apparatus of claim 1 wherein said feed conduit has at least two significant directional bends.

10. The apparatus of claim 4 wherein said two blowers are positioned between the planes of the side panels of said chamber.

11. The apparatus of claim 1 wherein a slide plate is associated with the exit extremity of said feed conduit and configured in a manner to permit passage of air while catching fallen stem material and causing said stem material to proceed downwardly and rearwardly toward said conveyor belt.

12. The apparatus of claim 11 wherein said slide plate is comprised of a spaced apart series of longitudinal members.

* * * * *